United States Patent [19]

Venable et al.

[11] Patent Number: 4,516,815

[45] Date of Patent: May 14, 1985

[54] RF FILTER CONNECTOR

[75] Inventors: Thomas L. Venable; Geoffrey C. Robinson, both of Erie; Raymond D. Loeslein, Fairview, all of Pa.

[73] Assignee: Spectrum Control, Inc., Fairview, Pa.

[21] Appl. No.: 386,037

[22] Filed: Jun. 7, 1982

[51] Int. Cl.[3] ..... H01R 4/66; H01R 15/06; H01R 13/648

[52] U.S. Cl. ..... 339/14 R; 339/143 R; 339/147 R

[58] Field of Search ..... 339/147 R, 147 P, 14 R, 339/136 M, 143 R

[56] References Cited

U.S. PATENT DOCUMENTS

| | | | |
|---|---|---|---|
| 3,667,445 | 7/1972 | Brancaleone | 339/143 R |
| 3,703,701 | 11/1972 | Zimmerman, Jr. | 339/147 R X |
| 3,790,858 | 2/1974 | Brancaleone et al. | 339/14 R X |
| 3,825,874 | 7/1974 | Peverill | 339/147 R X |
| 4,029,386 | 6/1977 | Krantz, Jr. et al. | 339/143 R |
| 4,033,654 | 7/1977 | Ross | 339/143 R |
| 4,239,318 | 12/1980 | Schwartz | 339/143 R |

*Primary Examiner*—Steven C. Bishop

*Attorney, Agent, or Firm*—Marshall, O'Toole, Gerstein, Murray & Bicknell

[57] ABSTRACT

An RF filter connector with a one-piece housing formed of conductive material, a plurality of contacts, insulating spacers, high frequency filter elements on selected or all contacts, a conductive ground plane in conductive engagement with each filter element and the housing, and a spring clip member for clip mounting on the connector housing. When mated with another connector, the RF filter connector housing and the other connector housing will be maintained in conductive engagement to effect reliable EMI grounding of undesired signals. An RF filter connector having components which may be readily hand asembled or be automated machinery.

7 Claims, 7 Drawing Figures

RF FILTER CONNECTOR

This invention relates generally to electrical filter connectors of the type which provide protection against electromagnetic interference (EMI) and in particular, to such a connector which may be readily assembled and provides reliable EMI filtering and shielding integrity.

BACKGROUND OF THE INVENTION

Electromagnetic interference (EMI) filter connectors are currently in use to provide shielding or filtering of undesired noise or spurious signals which may be present on the electrical contacts at the connector. Such EMI filter connectors are also referred to in the trade as RF filter connectors, or simply as filter connectors, and such terms may be interchangeably used herein. Typically, filter connectors are used with electrical systems having a number of sub-assemblies interconnected by multi-conductor cables to protect the conductors from EMI.

In general, prior available filter connectors contain many components, such as two or more outer shell or housing members, several separate insulator spacer members, and a plurality of contacts (such as 9, 15, 25, 37 contacts, etc.) each having a high frequency ceramic capacitor or other high frequency filter network mounted thereon along with a grounding element. Many of the installations involve miniature or sub-miniature connector components which necessitates manufacturing of the components with high dimensional tolerances, thus requiring time consuming and somewhat tedious hand assembly of the various components into an assembled filter connector.

The ever-increasing use of electronic systems involving high speed data generation and transfer, such as computers, word processors, etc., in commercial as well as home applications has provided an increasing demand for filter connectors. Fulfillment of this demand is not foreseen with presently available multiple component connectors requiring time consuming hand assembly.

Presently available filter connectors rely upon close fitting of respective conductive outer housings during mating of two connectors to provide a conductive connection between the respective housings. Screws and nuts may be inserted through both housings of the mated connectors in order to insure a reliable electrical connection between the housings, however, this is seldom done in practice, and instead the normal close fit between the housing components is relied on instead. If the connector housings are not securely conductively mated, this may lead to ineffective and unreliable EMI shielding.

It is therefore desired to provide an EMI filter connector having a minimum of components and which can be readily hand assembled or preferably lends itself to automated assembly. In addition, it is desired to provide a reliable EMI filter connector in which the respective connector housings are securely maintained in conductive engagement when mated so as to insure reliable and effective EMI filtering integrity.

SUMMARY OF THE INVENTION

In accordance with one aspect of the principles of the present invention, there is provided an EMI filter connector which includes a one-piece housing formed of conductive material, a plurality of elongated contacts supported in spacial separation within the housing by a respective insulating spacer member at the contact ends. A high frequency filter element is mounted on all or selected contacts. A conductive ground plane is insertable into the one-piece housing and adapted for conductive engagement with each of the filter elements and the housing so as to conductively ground any EMI on the contacts.

The filter connector components can be readily assembled by inserting the contacts into respective apertures provided in the ground plane so that the ground plane electrically conductively engages each of the filter elements. The ground plane and contacts may then be located within and electrically connected to the conductive one-piece housing, and the two insulating spacer members inserted on respective contact ends into the housing to securely maintain the connector components in position.

In accordance with another aspect of the present invention, housing contact means secure reliable electrical conductivity between the housings of two mating connectors solely in response to the mating connection. In particular, the housing contact means includes a spring clip member for clip mounting on the connector housing. The spring clip member includes at least one spring leaf arm and a joined latch arm and hook end in the form of a clip so as to enable the spring leaf arm to snugly engage in conductive contact the housings as the connectors are mated. A portion of the connector housing includes respective slots for each hook end and may include grooves for accommodating respective spring leaf arms.

BRIEF DESCRIPTION OF THE DRAWINGS

The invention will be better understood from the following detailed description thereof taken in conjunction with the accompanying drawings, in which.

DETAILED DESCRIPTION

Figure 1:
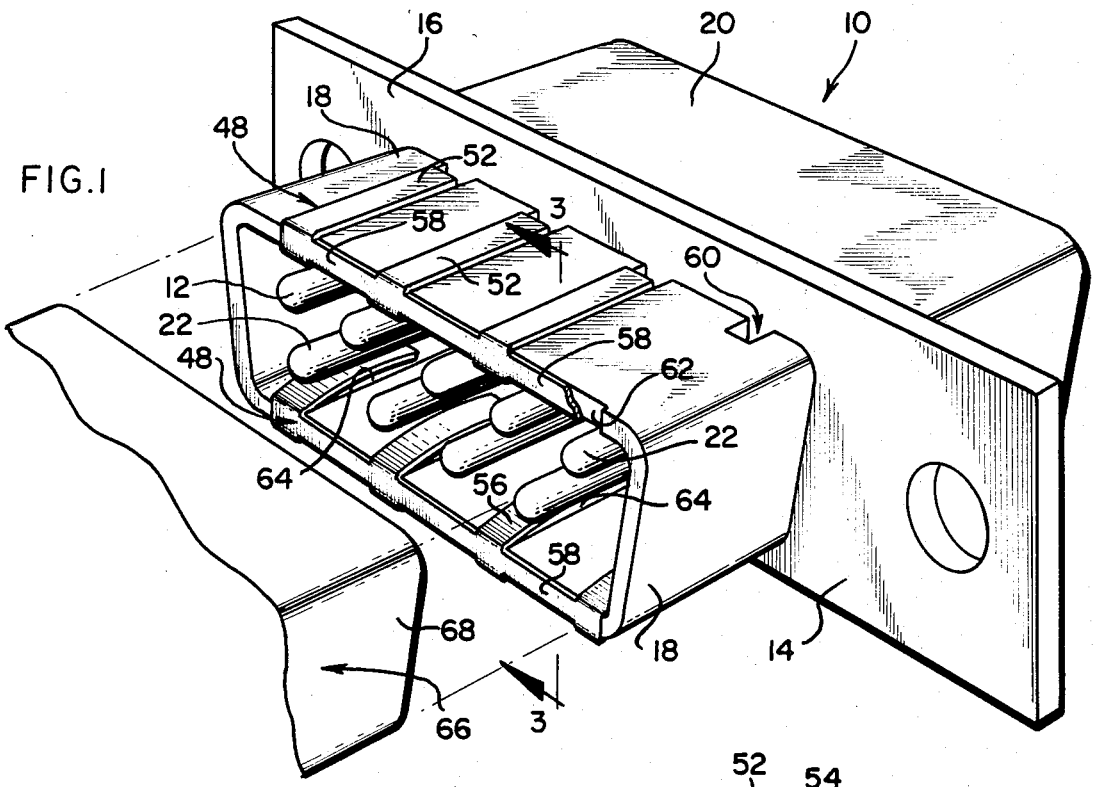
FIG. 1 is a perspective view illustrating an EMI filter plug connector incorporating pin contacts and constructed according to the present invention.
Figure 2:
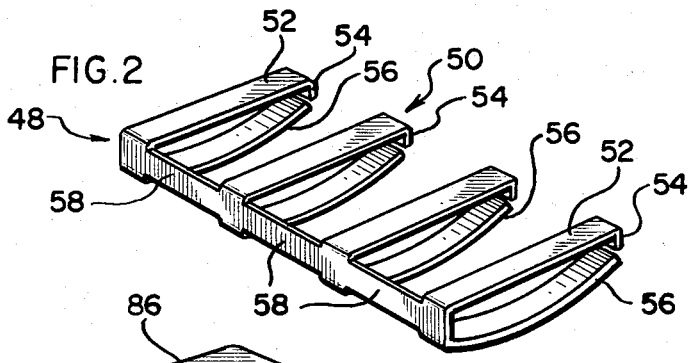
FIG. 2 is a perspective view illustrating a housing contact member in the form of a spring clip member having spring-like elements for insuring reliable conductive contact of connector housings when the connector of FIG. 1 is mated with a suitable socket connector.
Figure 3:
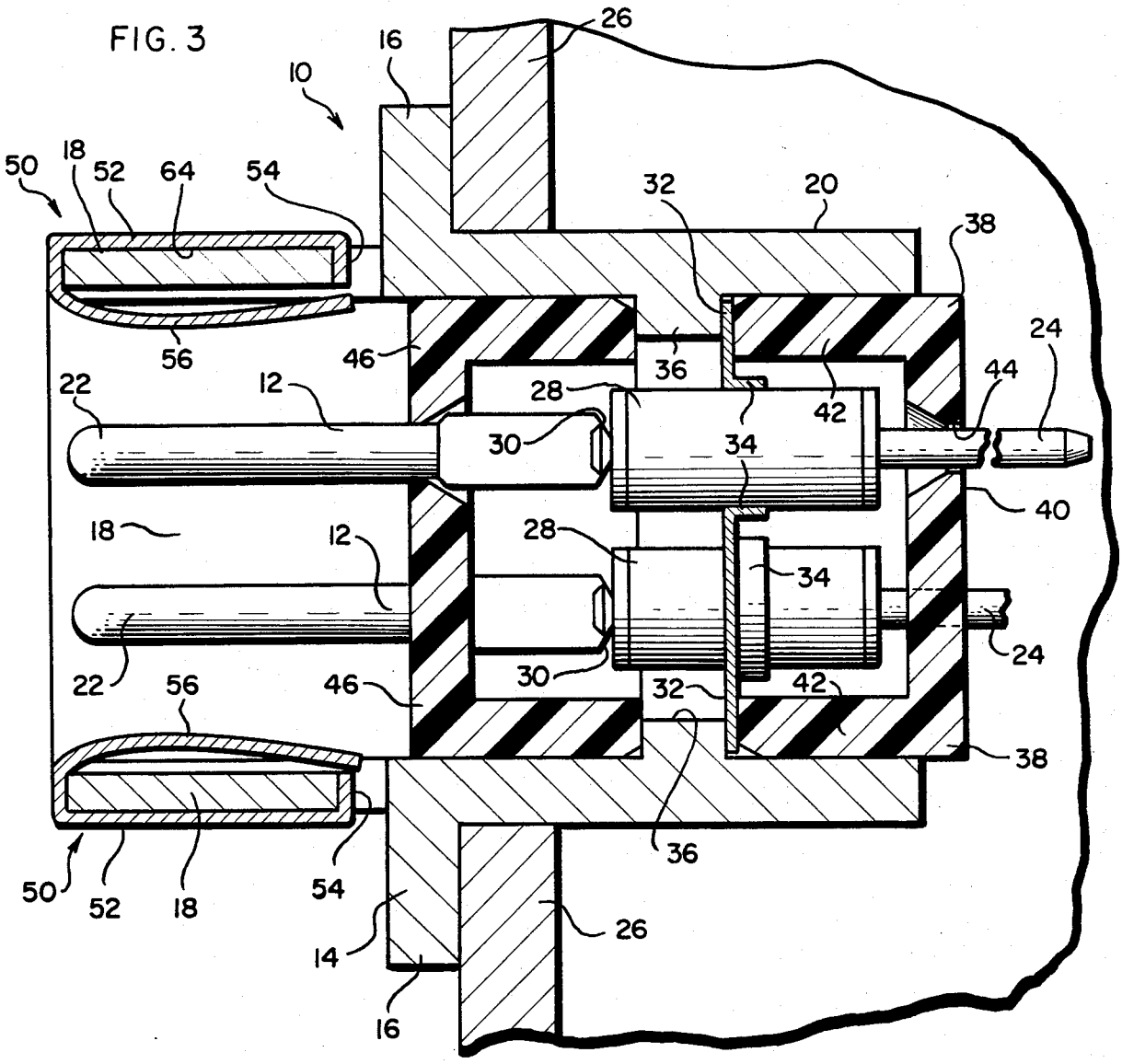
FIG. 3 is a sectional view taken along section lines 3—3 of FIG. 1 illustrating the components forming the EMI filter plug connector of FIG. 1.

Referring now to FIGS. 1–3 of the drawings, there is illustrated a filter connector 10 for grounding or shielding a plurality of elongated contacts 12 contained within a one-piece housing 14 from electromagnetic interference (EMI). One-piece housing 14 includes a base mounting portion 16, a front portion 18 and a rear portion 20 formed as a unitary structure of conductive material, such as aluminum or an aluminum alloy. Each contact 12 includes a contact engaging end 22 and a wire termination end 24. As is seen most clearly in FIG. 3, with respect to filter connector 10, contact engaging portion 22 is in the form of a pin or plug located within housing front portion 18, whereas wire termination end 24 extends from within the connector housing and projects outwardly beyond rear housing portion 20.

It is to be understood of course, that filter connector 10 illustrates one embodiment of the invention as a plug connector which may be mounted on a system sub-assembly 26. The sub-assembly wiring may be connected by standard wire wrap procedure onto termination 24. Other standard terminations, such as solder or insulation piercing may be provided. Suitable socket connectors can be inserted into front connector portion 18 to engage the pins comprising contact engaging portions 22. It is to be further understood that this illustration is merely for purposes of describing an embodiment of the invention, whereas the principles herein recited can be applied as well to the socket connectors as illustrated herein, and to cable to cable connectors.

An EMI filter network element 28, such as a high frequency ceramic capacitor or a high frequency pi filter network is inserted over the contact termination, butted against a contact shoulder 30 and secured in position utilizing well-known techniques such as flame soldering. The EMI filter network elements are commercially available items, tubular in form with a central aperture adapted for mounting on a contact.

A generally rectangular ground plane or plate 32 conforming substantially to the interior dimensions of connector rear portion 20 is formed of conductive material such as brass, solder coated on one or both sides. The ground plane is provided with a plurality of apertures corresponding to the number of contacts to be included in connector 10. Each of the ground plate apertures may be formed by punching one side of the plate so as to form a collar 34 of one or more ridges on the opposite plate face, the collar diameter corresponding to the outer surface diameter of element 28 and permitting the collar and surface to be soldered together. A rim 36 protrudes inwardly within the housing to locate ground plate 32. The ground plate may then be maintained in position and electrically connected to the housing at rim 36 by soldering.

A rear C section-shaped insulating member 38 includes a central portion 40 with an upstanding wall portion 42 provided to maintain contact termination portions 24 in spacially separated position. Central portion 40 includes a plurality of apertures 44 corresponding to the maximum number of contacts to be placed on connector 10, and with each aperture being suitably sized for snug fit engagement with a respective contact termination portion. Upright wall portion 42 may be sized for snug fit engagement within rear housing portion 20 as shown in FIG. 3 and located until the upright wall end contacts the ground plane opposite rim 36. Another insulating spacer 46 similar to insulating spacer 38 is provided in a similar manner with apertures and an upright portion so as to be slidably insertable with a snug fit into front connector portion 18 and butted against rim 36 so as to spacially support contact engaging portions 22. Both insulating spacers may be cemented into position or provided with ridges to lock within the housing. Alternatively, the housing may be formed with a crimp after the spacers have been inserted into position to prevent the spacers from moving out of the housing.

In order to provide reliable electrical conductivity between housings of mated connectors, there is provided housing contact means such as a spring clip member 48 as shown in FIG. 2. Spring clip member 48 is C-shaped with an open face end and includes a series of similarly C-shaped spring clip contacts 50 each having a latch arm 52 with a hook end 54 and a curved spring leaf arm 56. Spring clip member 48 is formed of a conductive material and may be readily shaped and spring tempered so as to have one or more spring clip contacts 50 with connecting links 58.

Figure 4:
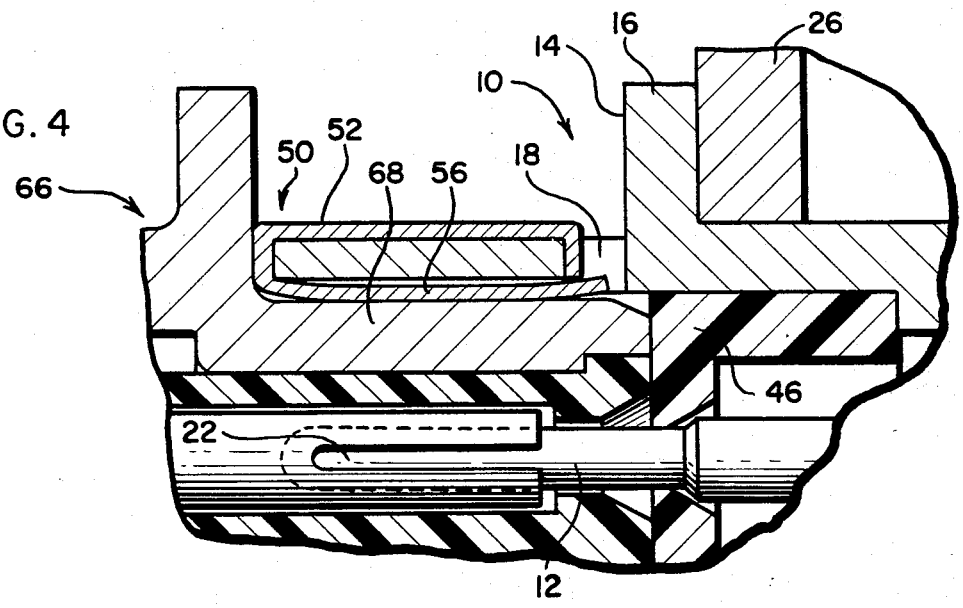
FIG. 4 is a sectional view, partly fragmented of the EMI filter plug connector of FIG. 1 mated with a corresponding socket connector and the spring clip member securely engaged between respective housings.

Front housing portion 18 is provided with a plurality of slots 60 and a detent 62 to accommodate the spring clip member which is clip mounted with the open face end clip mounted on the housing as shown in FIGS. 1 and 3. The length of the spring clip member conforms with the length of detent 62, and as further aided by hook ends 54 located within respective slots 60 thereby maintains the spring clip member in position. In the case of plug connector 10, latch arm 52 is disposed on the outside surface of housing front portion 18 with the spring leaf arm 56 being located within the housing interior and aligned with corresponding housing grooves 64. Thus, when a socket connector 66 having a conductive housing 68 is mated with filter plug connector 10 (See FIG. 4) each spring leaf arm 56 is depressingly engaged by housing 68 thereby forcing each spring leaf into its corresponding housing groove 64. A positive, reliable electrically conductive engagement is thus provided between housing 68 and front housing portion 18 of filter plug connector 10 to insure effective EMI filtering. While only eight spring clip contacts 50 have been shown in connection with plug connector 10, the actual number may vary with connector sizes as desired in order to provide reliable housing contact in mated connector situations.

In assembling filter plug connector 10 shown in FIGS. 1 and 3, the sequential steps involve: placing an EMI filter network on each contact; inserting the contacts through respective apertures into the ground plane; placing the ground plane and contacts into the housing; inserting the respective insulating spacers into the housing from each end; and snapping the spring clip members into position with the open face clip end engaging the housing Suitable soldering techniques may be utilized as previously described during the assembly procedure in order to securely maintain and electrically connect the housing, ground plane and EMI filter networks.

Figure 5:
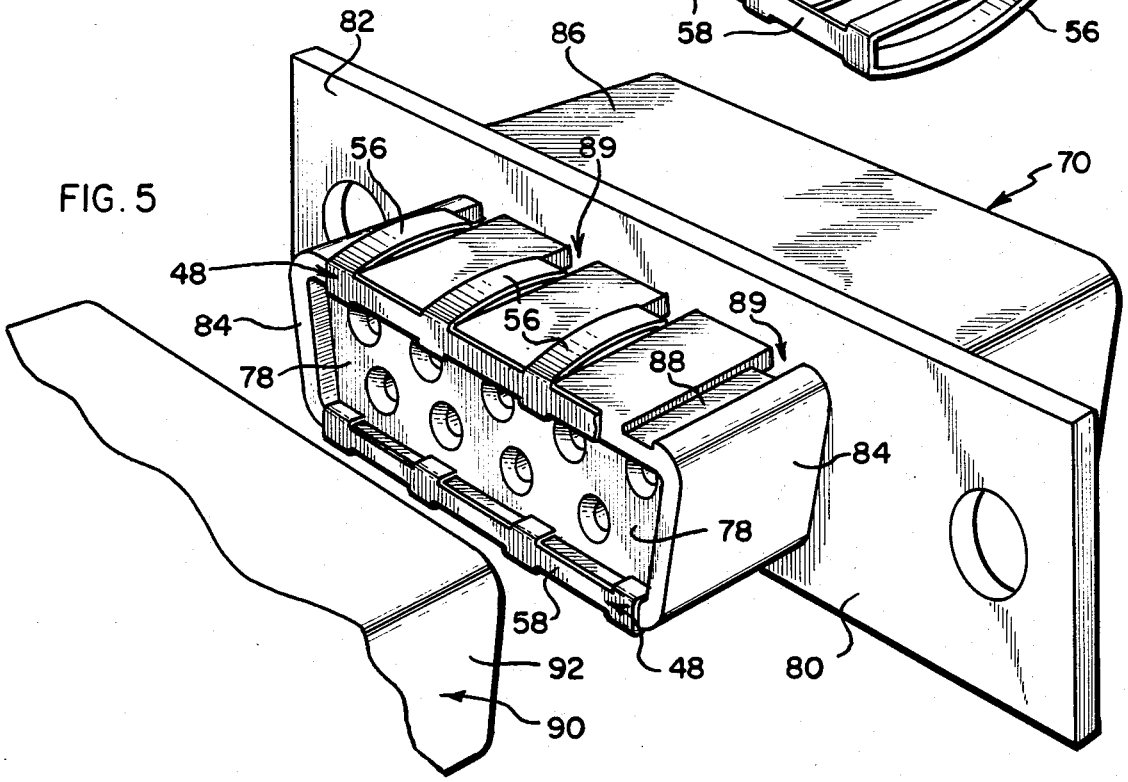
FIG. 5 is a perspective view of an EMI filter socket connector constructed according to the principles of the present invention.
Figure 6:
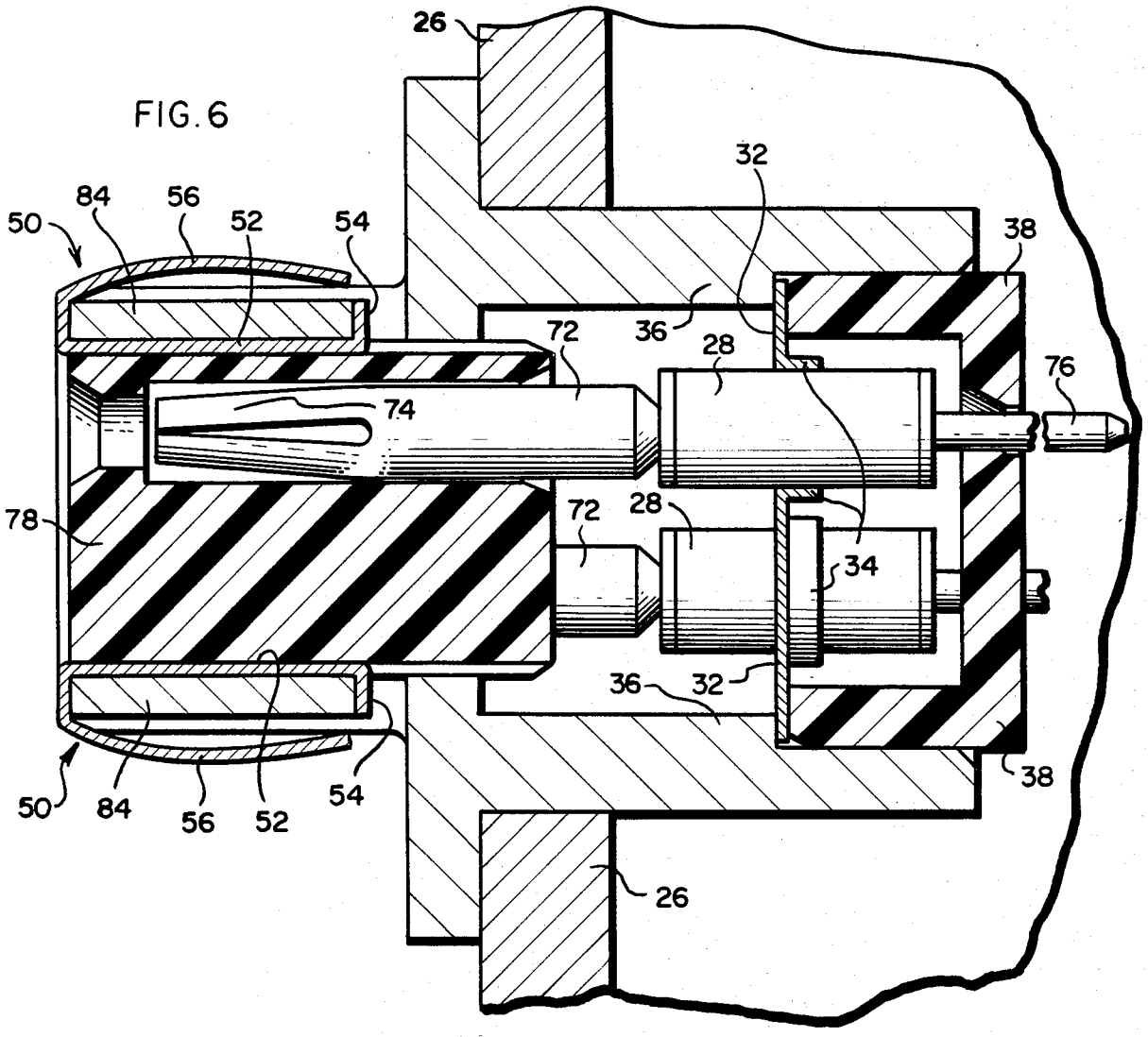
FIG. 6 is a sectional view illustrating the components of the socket connector of FIG. 5.

Referring to FIGS. 5 and 6, there is illustrated a filter socket connector 70 instructed in accordance with the principles of the present invention to incorporate the features previously described in connection with plug filter connector 10, and wherein like reference numerals identify like elements in the drawings. In this case, contacts 72 include a contact engaging portion or socket 74 at one end and a termination portion 76 at the other end. A generally block shaped insulating spacer 78 is provided with suitable apertures to accommodate contact engaging portion 74. One piece housing 80 is formed of conductive material and includes a base 82, front portion 84 and rear portion 86. Front housing portion 84 includes a series of grooves 88 on the exterior surface to accommodate spring leafs 56 as shown in FIG. 5. It may be noted that a detent, such as detent 62, has not been provided on front housing portion 84 of the filter socket connector. If desired, detent 62 may as well be eliminated from the filter plug connector of FIG. 1, and the spring clip member maintained in position sufficiently by the clip action on the housing and hook 54 in slot 60.

Figure 7:
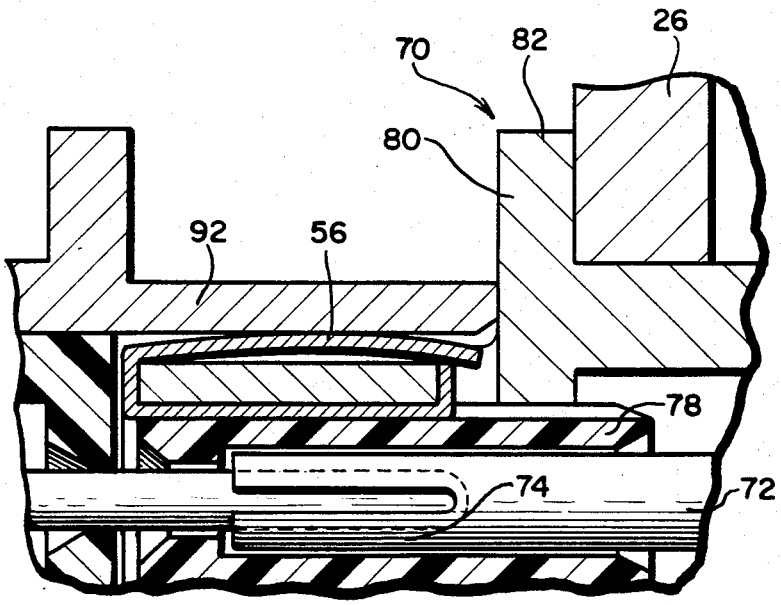
FIG. 7 is a sectional view, partly fragmented illustrating the EMI filter socket connector of FIG. 5 mated with a suitable plug connector.

Thus, when socket connector 70 is mated with a plug connector 90, having a conductive housing 92, a reliable contact between connector housings is provided by depressing engagement of housing 92 and spring leafs 56 as shown in FIG. 7. Slots 89 are provided in front housing portion 84.

Assembling of socket connector 70 may be accomplished in a similar sequence to that previously described with respect to plug connector 10. It may be noted that in the case of socket connector 70, the spring clip member is inverted so that spring leafs 56 are on the outside of the housing rather than in the inside as in the case with plug connector 10.

Spring clip member 48 may be formed of a suitable electrically conductive material about 0.004 inch thick, spring tempered, with all or selected surfaces gold plated. Spring leaf arm 56 and latch arm 52 may be about 0.060–0.080 inch wide. Alternatively, the spring leaf arm and latch arm may be about 0.25 inch wide with a central hook end of about 0.060–0.080 inch. Also, respective grooves 64 and 88 may be eliminated by suitably dimensioning the respective housing front portions 18 and 84. The inside surfaces of front housing portion 18 and the outside surfaces of front housing 84 may be gold plated, and the free ends of the spring leaf arms may be slightly split to enable a more positive electrical conductive engagement between housings if desired. Other housing contact means may be provided in accordance with the teachings herein to secure housing conductive contact and thereby provide reliable and effective EMI filtering integrity.

The foregoing detailed description has been given for clearness of understanding only, and no unnecessary limitations should be understood therefrom, as modifications will be obvious to those skilled in the art.

What is claimed is:

1. A filter connector with electromagnetic (EMI) shielding comprising:

a housing formed of electrically conductive material and having at least one slot at one end of said housing;

a plurality of elongated contacts, each having a front contact engaging portion and a rear termination portion, locatable within said housing with said front contact engaging portion at said one end of said housing and said rear termination portion at the other end of said housing;

an EMI filter element mounted intermediate the front contact engaging portion and the rear termination portion on each of said contacts;

a conductive ground plate insertable into said housing adapted for conductive engagement with each of said EMI filter elements and said housing for conductively grounding any EMI on said contacts; and a C-shaped spring clip member with the open end of the C-shape engaging said slot and said clip mounted on said housing at said one end with a portion of the housing in the open end for reliably insuring electrical conductive engagement between respective housings when mated with another connector;

said spring clip member including a spring leaf arm formed as a continuous extension of and oppositely facing a latch arm having a hook end, said hook end insertably engaged in said slot, and said latch arm and spring leaf arm being clip mounted on said housing with said housing portion captured therebetween to enable said spring leaf arm to be depressed between respective housings during connector mating, thereby securing electrically conductive engagement therebetween.

2. A filter connector according to claim 1, wherein said housing includes a detent for receiving and maintaining said spring clip member in position on said housing.

3. A filter connector with electromagnetic interference (EMI) shielding comprising:

a one-piece housing formed of conductive material, and having respective front and rear housing portions, said front housing portion having a slot;

a plurality of elongated contacts, each having a contact engaging portion and a terminating portion, locatable within said housing with said contact engaging portion at said front housing portion and said terminating portion at said rear housing portion;

an EMI filter element mounted on each of said contacts intermediate the respective contact engaging portion and said terminating portion;

a pair of respective spacer members formed of insulating material and adapted for insertion into said one-piece housing to spacially support said plurality of elongated contacts at respective ends within said one-piece housing;

a conductive ground plane in the form of a plate adapted for conductive mounting engagement within said housing, said plate having apertures for each of said contacts, said contacts being insertable into respective apertures to provide a conductive grounding path from said contacts through said EMI filter elements and said plate to said housing; and a spring clip member including a spring leaf arm portion and a latch arm portion joined in the form of a C-shaped open face clip and said latch arm portion having a hook end;

said spring clip member mounted with said open face clip engaging said front housing portion and with the spring leaf arm portion and latch arm portion capturing said front housing portion therebetween and the hook end engaged in said slot, so that the spring leaf arm portion is depressingly engageable with the respective housing of another connector when mated therewith, to provide a secure electrically conductive path between said housings.

4. A filter connector according to claim 3, wherein said front housing portion includes a detent for positionally locating said spring clip member thereon.

5. A filter connector according to claim 4, wherein said front housing portion includes a groove adapted to receive said spring leaf arm.

6. A filter connector according to claim 3, including an abutment within said housing forming a stop for locating said ground plane.

7. A filter connector according to claim 6 wherein said abutment forms a stop for each of said insulating spacer members.

* * * * *